US005620109A

United States Patent [19]

Madden

[11] Patent Number: 5,620,109

[45] Date of Patent: Apr. 15, 1997

[54] ASYMMETRICAL PORTABLE DISPENSER

[76] Inventor: Mark L. Madden, 102 Whispering Pines Dr., Anderson, S.C. 29621

[21] Appl. No.: 494,673

[22] Filed: Jun. 26, 1995

[51] Int. Cl.[6] ..... B65D 83/04; B65D 43/20

[52] U.S. Cl. ..... 220/346; 220/8; 206/536

[58] Field of Search ..... 220/8, 345, 346; 206/459.5, 536, 538, 540, 822, 0.8–0.84, 121, 131, 443; 222/559, 522, 523, 526

[56] References Cited

U.S. PATENT DOCUMENTS

| | | | |
|---|---|---|---|
| D. 166,147 | 3/1952 | Dunbar | D58/13 |
| 828,151 | 8/1906 | Upjohn . | |
| 889,568 | 6/1908 | Albrecht . | |
| 1,137,642 | 4/1915 | Lingner | 206/121 |
| 1,265,069 | 5/1918 | Fetsch | 206/121 |
| 1,352,238 | 9/1920 | Arthur . | |
| 2,162,222 | 6/1939 | Lachter | 206/5 |
| 2,367,019 | 1/1945 | Haag | 206/0.83 |
| 2,481,302 | 9/1949 | Fogel | 220/345 X |
| 2,534,100 | 12/1950 | Baumgartner | 220/41 |
| 3,791,514 | 2/1974 | Watanabe | 220/346 X |
| 4,043,448 | 8/1977 | Tanaka | 206/1.5 |
| 4,284,204 | 8/1981 | Carey, Jr. | 220/346 |
| 5,080,222 | 1/1992 | McNary | 220/346 X |

FOREIGN PATENT DOCUMENTS

| | | | |
|---|---|---|---|
| 15323 | 11/1911 | Denmark | 206/0.82 |
| 27589 | 4/1981 | European Pat. Off. | 220/346 |
| 58515 | 9/1953 | France | 206/0.8 |
| 2706065 | 8/1978 | Germany | 220/345 |
| 324105 | 8/1957 | Switzerland | 220/345 |
| 834176 | 5/1960 | United Kingdom | 206/536 |

*Primary Examiner*—Allan N. Shoap
*Assistant Examiner*—Nathan Newhouse
*Attorney, Agent, or Firm*—Gerald R. Boss; Cort Flint

[57] ABSTRACT

An asymmetrical portable dispenser having a dispenser opening for dispensing small articles. Asymmetrical dispenser including an asymmetrical tray slidably mounted within a similarly configured asymmetrical sleeve for orientating the dispenser opening in an upward position by placing the opposite dissimilar side in an downward position.

2 Claims, 2 Drawing Sheets

ASYMMETRICAL PORTABLE DISPENSER

BACKGROUND OF THE INVENTION

This invention relates to a dispenser for containing and dispensing small articles and more particularly to a portable dispenser having an asymmetrical cross-section for indicating the correct position of dispersement and being easily operable by a person who experiences difficulty in grasping and rotating small objects.

Persons with arthritis in their hands are hindered in the strength and dexterity of their fingers. Unfortunately, when the need arises to take medication or the like, the arthritic person experiences difficulty in grasping a common pill dispenser's cap and generating sufficient torque to remove the cap from the dispenser. Furthermore, the grasping of the pill dispenser itself is a difficult task. Accordingly, a pill dispenser which rests in the hands of the arthritic person having an easily accessible opening is desirable. However, to prevent the accidental spillage of pills, the dispenser should indicate to the user where the location of the dispenser's opening is located. For people who are visually impaired, the dispenser opening indicator should be easily recognizable.

U.S. Pat. No. 889,568 discloses a compartment for containing small articles slidably mounted within a casing. However, this tray is symmetrical and the user may accidently retrieve the tray from the sleeve with the opening of the tray pointing downward thus causing an accidental spillage of the articles contained within the tray. U.S. Pat. No. 4,043,448 discloses a child-proof container which contains small articles whereupon the opening of the container is located at one end of the container. However, in order to open the cover the user is required to deform the container.

U.S. Pat. No. 828,151 discloses a receptacle which is corrugated longitudinally to form longitudinal troughs for pills. The receptacle is designed for presenting a container containing pills so the box may be opened so that the coating from the pills is not ruptured or ground from the cover. The cover embraces the sides of the receptacle and are turned inwardly at the lower edges to engage the bottom of the receptacle. While such a design prevents the rupturing of the coating from the pills, it is not easily operable by a person with arthritis who has difficulty grasping objects. Since the receptacle has a lower profile than the cover, the receptacle will rest in the person's hand thereby preventing slidable movement of the receptacle. In order to operate the box, the sides of the cover must be grasped in moving the receptacle from the user's palm thereby moving the receptacle with respect to the cover. This manner of operation is difficult for the arthritic person. Alternatively, if the receptacle rests in the user's hand, the user must apply pressure to the cover to slide the cover with respect to the receptacle thereby exposing the pills. Once again, the application of force by a person with arthritis on the flat surface of the cover to move the cover with respect to the receptacle is very difficult. While this cover provides a suitable means for protecting the pills, it is not easily operable by an arthritic person.

U.S. Pat. No. 2,534,100 discloses a container for cosmetics having a box and a cover. This patent discloses the use of a asymmetrical sleeve for receiving a asymmetrical tray which does not produce a reliable positioning of the trays opening in an upward direction. Accordingly, the danger exists in that the tray would be open with the tray pointing downward thereby dislodging the contents stored within the container. Such a design, is undesirable due to the consequences of the potential of dropping the stored items and that the arthritic person would have further difficulty in picking up the dropped items and placing them back in the container.

Accordingly, an object of the present invention is to provide a small article dispenser which enables a person of limited dexterity to have access to the articles contained within the dispenser and which may easily be oriented;

Furthermore, an object of the present invention is to provide a small article dispenser for persons with limited dexterity and/or eyesight having an easily identifiable indicator indicating the position of the dispenser opening, thereby eliminating accidental spillage of the contained articles;

A further object of the present invention is to provide a small article container for people with limited dexterity which is portable and only requires the use of a finger for opening or closing the dispenser.

SUMMARY OF THE INVENTION

The above objectives are accomplished according to the invention by providing a portable dispenser having an accurately determinable dispensing position for dispensing small articles and which is easily operable by a person experiencing difficulty in grasping and manipulating small objects.

The dispenser includes a tray having an interior for containing small articles with a tray opening which faces upwards in a dispensing position for dispensing. A hollow sleeve having an asymmetrical sleeve cross-section and a central passage for receiving the tray covers the dispenser opening. The central passage of the sleeve also has an asymmetrical passage cross-section and is of sufficient size to receive a finger of the user. The tray has an asymmetrical tray cross-section corresponding with the central passage cross-section requiring receipt of the tray to occur within the sleeve in only one position which results in the dispensing opening facing upwards. The sleeve includes a continuous surface which surrounds the tray. The sleeve includes an exit opening through which the tray slides outwardly from and an actuation opening of a size sufficient to receive a finger permitting said finger to enter said central passage for encountering said tray for pushing the tray from the central passage of the sleeve placing said tray in said dispensing position. The asymmetrical profile of the sleeve enables the user to orientate the tray's opening upward for a correct dispensing position.

Thus it can be seen that a more advantageous method for storing small articles can be had according to the present invention. The structure of the present invention is designed to enable a user, even one with visual impairment, to ascertain the direction in which the dispenser opening is pointing due to the dissimilar shape of the tray. The dissimilar shape of the tray provides an asymmetrical cross-section which indicates to the user where the dispenser opening is pointing. Furthermore, the slidably mounted cover enables the user having limited dexterity to have access to the contained articles merely by pushing open the dispenser opening. The combination of an asymmetrical design for orientating the dispenser opening with a slidably mounted cover provides a user with limited dexterity and/or eyesight easy access to the contained items.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail.

Figure 1:
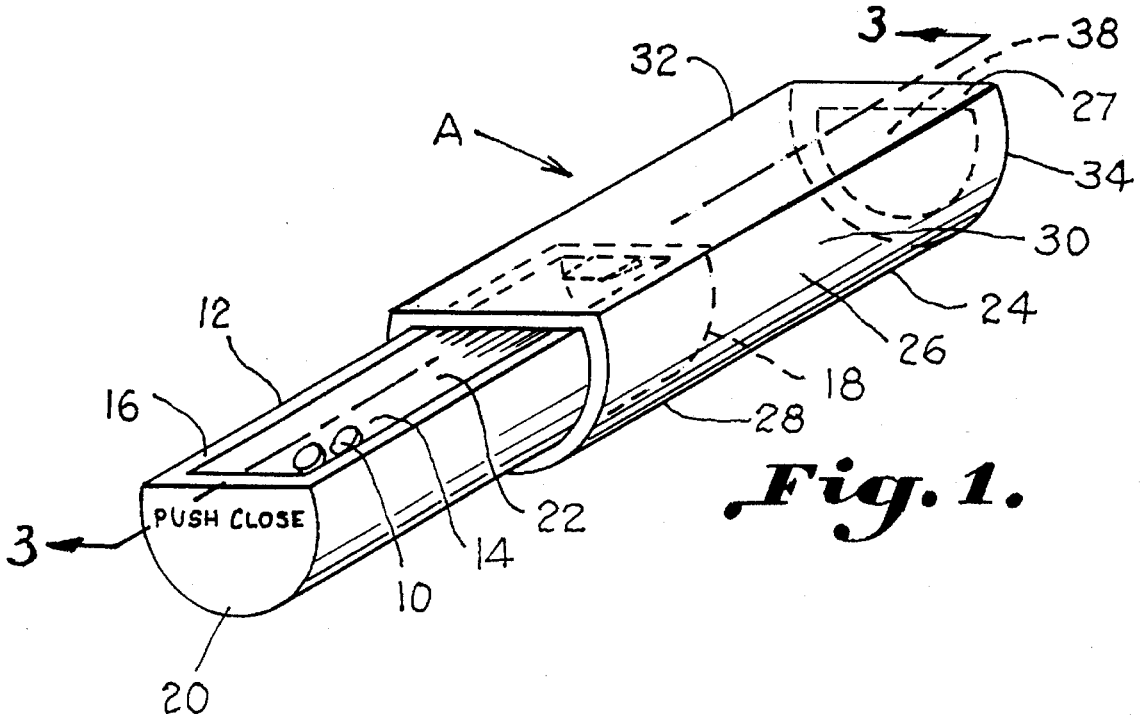
FIG. 1 is a perspective view of an asymmetrical dispenser according to the invention.
Figure 2:
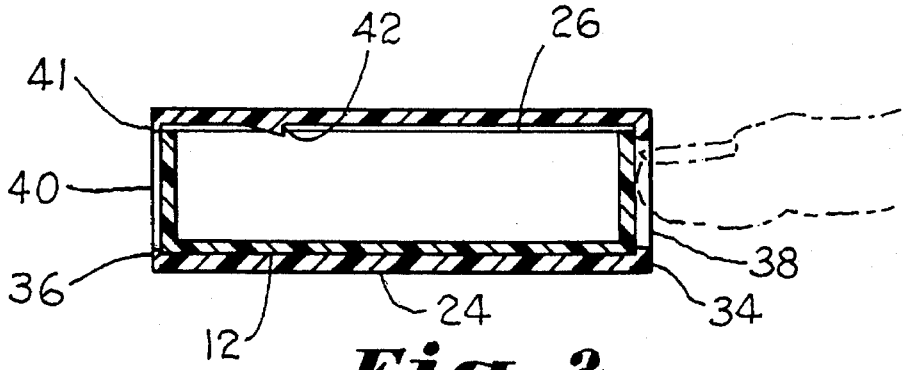
FIG. 2 is a sectional view of the asymmetrical dispenser taken along line 2—2 of FIG. 1.
Figure 3:
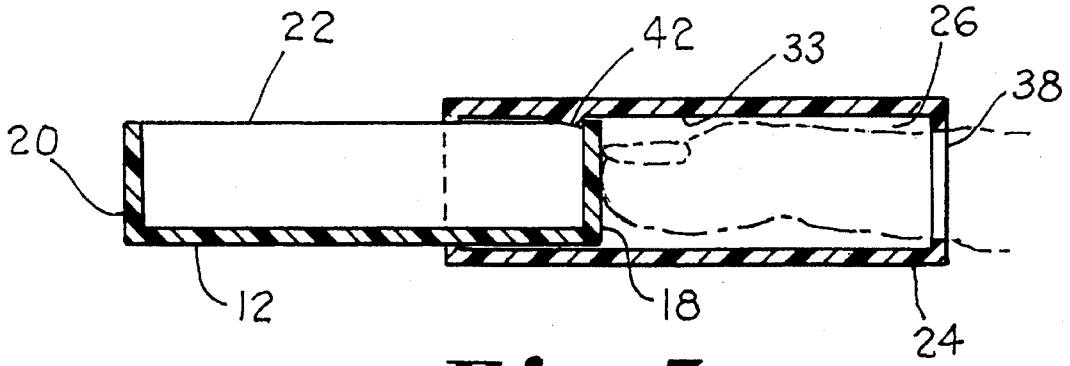
FIG. 3 is a sectional view of the asymmetrical cover taken along line 3—3 illustrating the opening of the tray through the use of a finger.

As shown in FIGS. 1, 2, and 3, a portable dispenser A having an accurately determinable dispensing position for dispensing small articles such as pills, and which is easily operable by a person who experiences difficulty in grasping and manipulating small objects is illustrated. Portable dispenser A is comprised of an elongated tray 12 which includes an interior 14 for containing small articles 10. Elongated tray 12 has a top 16, a first tray end 18 and second tray end 20. Elongated tray 12 includes a tray opening 22 which faces upward in a dispensing position for dispensing small articles 10 from interior 14. In the preferred embodiment tray opening 22 is defined within top 16.

As shown in FIGS. 1, 2, 3 and 4 a cover closes tray opening 22 preventing small articles 10 from exiting interior 14. The cover may be comprised of a sleeve 24 which includes a central passage 26. Sleeve 24 is asymmetrical in a lateral cross-section. Asymmetrical sleeve 24 has a sleeve top 27, a sleeve bottom 28 and sides 30 and 32 and first sleeve end 34 and second sleeve end 36. Top 27 and bottom 28 are of a dissimilar shape which define the asymmetrical cross-section of sleeve 24. In the preferred embodiment sleeve bottom 28 is arcuate and integral with sides 30 and 32 to form a U-shaped cross-section. Sleeve top 27 is flat thereby creating a half dome asymmetrical profile. The U-shaped profile enables dispenser A to fit comfortably within the user's palm.

Central passage 26 has a second asymmetrical cross-section. Tray 12 has an asymmetrical cross-section corresponding with the asymmetrical cross-section of central passage 26 requiring the receipt of tray 12 to occur solely in a first position whereby tray opening 22 is orientated upwardly. Elongated tray 12 is slidably mounted within central passage 26. Accordingly, sleeve 24 isolates tray 12 from the user's palm enabling tray 12 to easily slide from sleeve 24 exposing tray interior 14. With the asymmetrical configuration of dispenser A, tray 12, and central passage 26, the user can ascertain the position of tray opening 22 by orienting flat top 16 in an upward position and arcuate bottom 28 downward against the user's palm. The asymmetrical profile also indicates to a visually impaired person the correct orientation of the dispenser opening by the placement of the rounded profile of the U-shaped sleeve in the user's palm.

First end 34 has an actuation opening 38 and second end 36 has an exit opening 40. Actuation opening 38 is of a sufficient size to enable a finger to be inserted into central passage 26 and engage first tray end 18 and thus push elongated tray 12 from central passage 26 of sleeve 24. Central passage 26 is of a size sufficient to receive the user's finger. Second end 36 includes a resilient boss 41 which surrounds exit opening 40. Exit opening 40 is slightly smaller than tray 12 retaining tray 12 within central passage 26. However, with a slight pressure exerted against first tray end 18 through actuation opening 38, the boss's restriction is overcome. Also, tray 12 may be received in central passage 26 if a slight pressure is exerted against second tray end 20.

Figure 4:
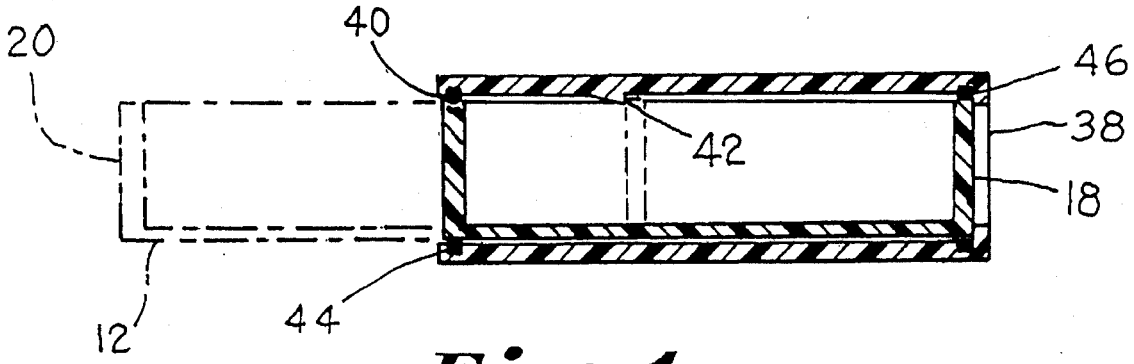
FIG. 4 illustrates asymmetrical tray in an open and closed position and a stop tab preventing the accidental dislodgement of the tray from the sleeve.

As shown in FIGS. 2, 3, and 4, in order to prevent the accidental discarding of tray 12 from sleeve 24, a stop tab 42 depends from internal roof 33 of sleeve 30 into central passage 26 and engages first tray end 18. Stop tab 42 may be located anywhere along the top of sleeve 30, but the preferred embodiment consists of stop tab being located close to exit opening 40 in order to maximize the accessible area of tray interior 14.

As shown in FIGS. 2 and 4 a seal is used to minimize the presence of air within interior 14. As previously mentioned, actuation opening 38 and exit opening 40 are smaller than tray 12. Accordingly, when tray 12 is fully contained within central passage 26, first tray end 18 and second tray end 20 seal off openings 38 and 40. As shown in FIG. 4, a first O-ring 44 and a second O-ring 46 seal tray 12 when tray 12 is contained within sleeve 24. In this configuration first O-ring 44 replaces boss 41.

While a preferred embodiment of the invention has been described using specific terms, such description is for illustrative purposes only, and it is to be understood that changes and variations may be made without departing from the spirit or scope of the following claims.

What is claimed is:

1. A portable dispenser having an accurately determinable dispensing position for dispensing small articles and which is easily operable by a person experiencing difficulty in grasping and manipulating small objects, said dispenser comprising:

a tray having an interior for containing said small articles, said tray having a tray opening which faces upwards in said dispensing position for dispensing said small articles from said interior;

a hollow sleeve having an asymmetrical sleeve cross-section and a central passage for receiving said tray and covering said dispenser opening, said sleeve having a first end and a second end;

said asymmetrical sleeve cross-section including a first surface facing upward in said dispensing position, and said sleeve cross-section having a second surface dissimilar to said first surface so that said person may reliably and accurately place said dispenser sleeve in said dispensing position by manually grasping said sleeve;

said second surface of said sleeve including an arcuate bottom integral with upright sides defining a generally U-shaped cross-section;

said central passage of said sleeve having an asymmetrical passage cross-section, said central passage having a size sufficient to receive a finger of said user along a general length of said passage;

said tray having an asymmetrical tray cross-section corresponding with said central passage cross-section requiring receipt of said tray to occur within said sleeve with said dispensing opening facing upwards solely in said dispensing position, said tray slidably mounted within said central passage;

said sleeve including a continuous surface which includes said first and second surfaces surrounding said tray when said tray is received within said central passage for isolating said tray from said user's palm;

said second end of said sleeve having an exit opening through which said tray slides outwardly from said sleeve exposing said tray interior for dispensing said small articles from said interior in said dispensing position;

said first end of said sleeve includes an actuation opening of a size sufficient to receive a finger permitting said finger to enter said central passage for encountering said tray for pushing said tray from said central passage of said sleeve placing said tray in said dispensing position; and said asymmetrical sleeve cross-section being constructed and arranged so that a user of said portable dispenser may reliably orientate said dispenser opening of said tray in said dispensing position to prevent accidental spillage of said small articles when uncovering said dispenser opening.

2. The dispenser of claim 1 wherein said sleeve includes a stop tab depending from the internal roof of said sleeve for engaging with a first tray end of said tray restricting said tray from being discarded from said sleeve.

* * * * *